US006443132B1

(12) United States Patent
Ricco et al.

(10) Patent No.: US 6,443,132 B1
(45) Date of Patent: Sep. 3, 2002

(54) INTERNAL COMBUSTION ENGINE FUEL INJECTOR

(75) Inventors: Mario Ricco, Casamassima; Adriano Gorgoglione, Modugno, both of (IT)

(73) Assignee: R.F. Societa Consortile per Azioni, Orbassano (IT)

( * ) Notice: Subject to any disclaimer, the term of this patent is extended or adjusted under 35 U.S.C. 154(b) by 0 days.

(21) Appl. No.: 10/034,632

(22) Filed: Dec. 28, 2001

(30) Foreign Application Priority Data

Dec. 29, 2000 (IT) ..... TO00A1230

(51) Int. Cl.[7] ..... F02M 37/04
(52) U.S. Cl. ..... 123/467; 123/458; 239/585.3
(58) Field of Search ..... 123/467, 458, 123/500, 501, 357; 239/584, 585.1, 585.2, 585.3, 585.4, 585.5; 251/129.15, 129.16

(56) References Cited

U.S. PATENT DOCUMENTS 4,379,442 A * 4/1983 Simko ..... 123/458
5,086,980 A * 2/1992 Hickey ..... 239/585.3
5,820,101 A * 10/1998 Ricco ..... 251/129.16
6,161,783 A * 12/2000 Press ..... 239/585.3
6,199,774 B1 * 3/2001 Ricco ..... 239/533.8
6,213,098 B1 * 4/2001 Kato et al. ..... 123/467
6,302,087 B1 * 10/2001 Schraudner et al. ..... 123/467
6,305,355 B1 * 10/2001 Hoffmann et al. ..... 123/467

* cited by examiner

*Primary Examiner*—Carl S. Miller
(74) *Attorney, Agent, or Firm*—Ladas & Parry

(57) ABSTRACT

The injector has a hollow body housing a fuel metering valve closed by a closing spring; and a support housing an electromagnet controlling an armature. The support is connected to the hollow body, and the armature provides for opening the valve. The armature is fitted inside the hollow body by means of a leaf spring hinge having an annular portion fixed between the hollow body and the support, and a projecting radial tongue fixed to a central portion of the armature. The tongue, together with at least one radial appendix of the leaf spring hinge, provides for arresting the armature with a predetermined clearance with respect to the core of the electromagnet.

12 Claims, 2 Drawing Sheets

INTERNAL COMBUSTION ENGINE FUEL INJECTOR

The present invention relates to an internal combustion engine fuel injector comprising a hollow body housing a fuel metering valve; and a support connected to said hollow body and housing an electromagnet controlling an armature of said valve.

BACKGROUND OF THE INVENTION

In known technology, the armature has a stem guided axially by a fixed guide to a high degree of precision, e.g. with a radial clearance of about 10 microns. Since the stem increases the mass of the movable armature assembly, to reduce the response time of the electromagnet, it has been proposed to disconnect the armature axially from the stem. In known injectors, to connect the stem to the armature, the armature has an integral guide sleeve, and the stem has a groove engaged by a C-shaped retaining member which is housed in a depression on the armature opposite the sleeve.

Known injectors have various drawbacks. First of all, machining the guide sleeve, stem and fixed guide and assembling the injector are complicated, expensive jobs. And secondly, the armature and sleeve must be made of wear-resistant ferromagnetic material capable of withstanding both high-precision machining and wear with respect to the stem.

SUMMARY OF THE INVENTION

It is an object of the present invention to provide a fuel injector which is highly reliable, is cheap and easy to produce and assemble, and provides for eliminating the drawbacks typically associated with known injectors.

According to the present invention, there is provided an internal combustion engine fuel injector comprising a hollow body housing a fuel metering valve; and a support connected to said hollow body and housing an electromagnet controlling an armature in turn controlling said valve; said valve closing a control chamber on which high-pressure fuel acts; said valve normally being closed by a closing spring acting on said armature and which overcomes the action of the fuel in said control chamber; and said valve being opened when said electromagnet activates said armature to overcome the action of said closing spring; characterized in that said armature is fitted inside said hollow body by means of a leaf spring hinge comprising a first portion fixed between said hollow body and said support, and a second portion fixed to said armature.

BRIEF DESCRIPTION OF THE DRAWINGS

A preferred, non-limiting embodiment of the invention will be described by way of example with reference to the accompanying drawings, in which.

DETAILED DESCRIPTION OF THE INVENTION

Figure 1:
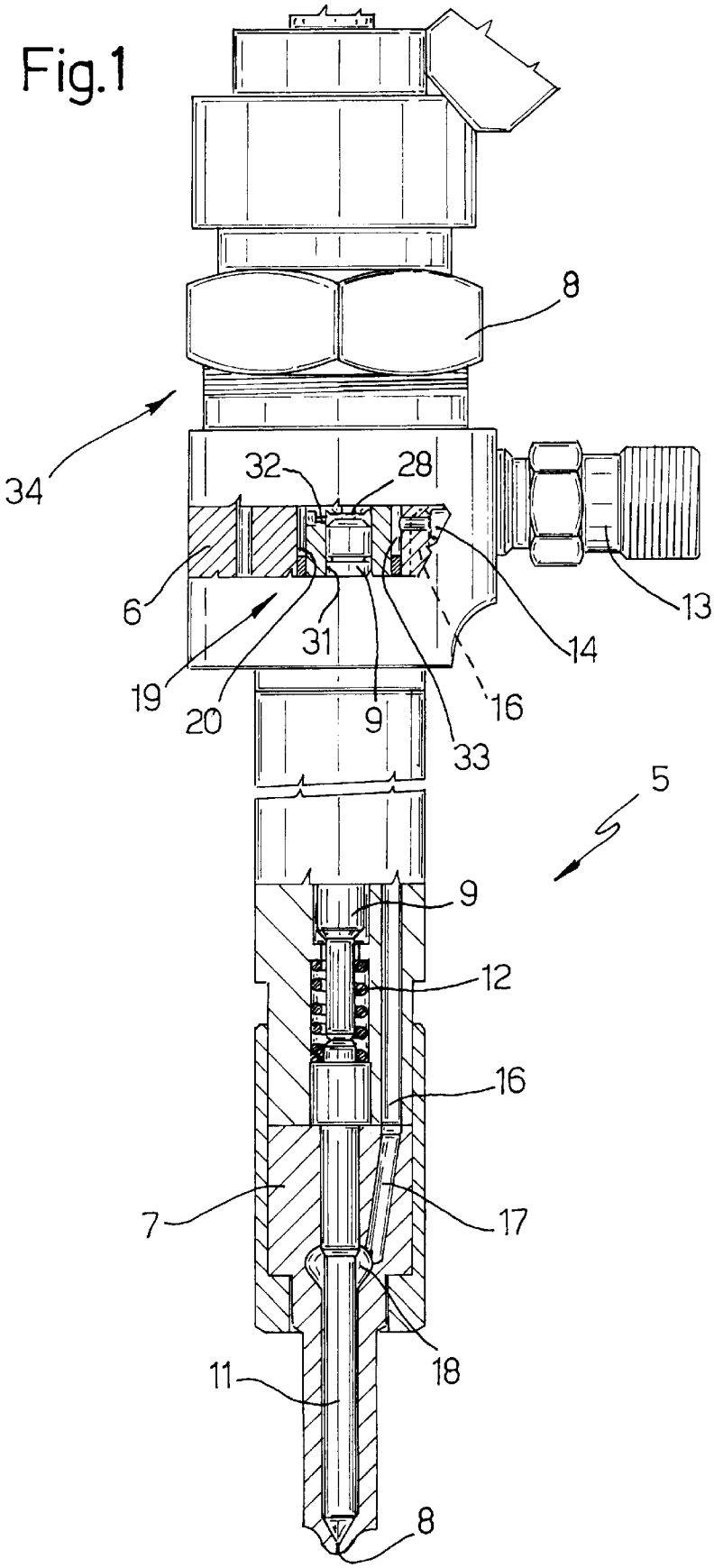
FIG. 1 shows a partly sectioned view of a fuel injector in accordance with the invention.

Number 5 in FIG. 1 indicates as a whole a fuel injector for an internal combustion engine. e.g. a diesel engine. Injector

5 comprises a substantially cylindrical, hollow body 6 connected to a nozzle 7 terminating with one or more injection orifices 8; a control rod 9 slides inside body 6 and engages one end of a pin 11 for closing hole 8; a spring 12 acts on pin 11 and assists in closing hole 8; hollow body 6 comprises an appendix 13 connected to the usual high-pressure fuel supply conduit; and appendix 13 has a hole 14 connected by conduits 16 and 17 to an injection chamber 18 of nozzle 7.

Injector 5 also comprises a metering valve indicated as a whole by 19 and housed inside a cavity 20 in hollow body 6. Cavity 20 is coaxial with a larger-diameter cavity 21 (FIG. 2), the lateral wall of which is connected to the lateral wall of cavity 20 by an annular shoulder 22 and a depression 23. Valve 19 comprises a shutter in the form of a ball 24 associated with the usual locating plate 26 and which engages a truncated-cone-shaped seat 27 communicating with a control chamber 28 in which the high-pressure fuel acts. More specifically, control chamber 28 is carried by a valve body 29 fixed in known manner inside cavity 20 and having an axial hole 31 (FIG. 1) for guiding one end of rod 9. Hole 31 communicates with control chamber 28 and, via a radial hole 32 and an annular gap 33, with high-pressure fuel inlet hole 14.

Injector 5 also comprises an electromagnet 34 controlling an armature 35 (FIG. 2) in turn controlling shutter 24, 26. Electromagnet 34 comprises an annular core 36 housed inside a support defined by a sleeve 37 coaxial with hollow body 6. Sleeve 37 is connected to hollow body 6, with the interposition of a seal 39, by means of a threaded ring nut 38 which keeps core 36 resting on a shoulder 40 of sleeve 37. Core 36 has an annular cavity housing a coil 41, which is energized electrically to attract armature 35 in opposition to a counteracting spring 42 closing valve 19. Spring 42 is housed in an axial hole 43 in core 36, and acts on armature 35 to keep ball 24 normally in the closed position. Armature 35 has radial slits 45 (see also FIG. 3) by which to discharge fuel from chamber 28 to axial hole 43 in core 36, and to minimize drag on armature 35.

According to the invention, armature 35 has an integral annular appendix forming a flange 58, and is fitted inside hollow body 6 by means of a leaf spring hinge indicated as a whole by 44 and defined by a blade of nonmagnetic or slightly ferromagnetic material.

More specifically, hinge 44 comprises an annular first portion 46, the inside diameter d of which is greater than the diameter of armature 35; and a second portion in the form of a tongue 47 projecting from and radially towards the center of annular portion 46. Annular portion 46 has an outside diameter D substantially equal to that of cavity 21 of hollow body 6, so that hinge 44 fits inside cavity 21 with substantially no radial clearance.

Figure 2:
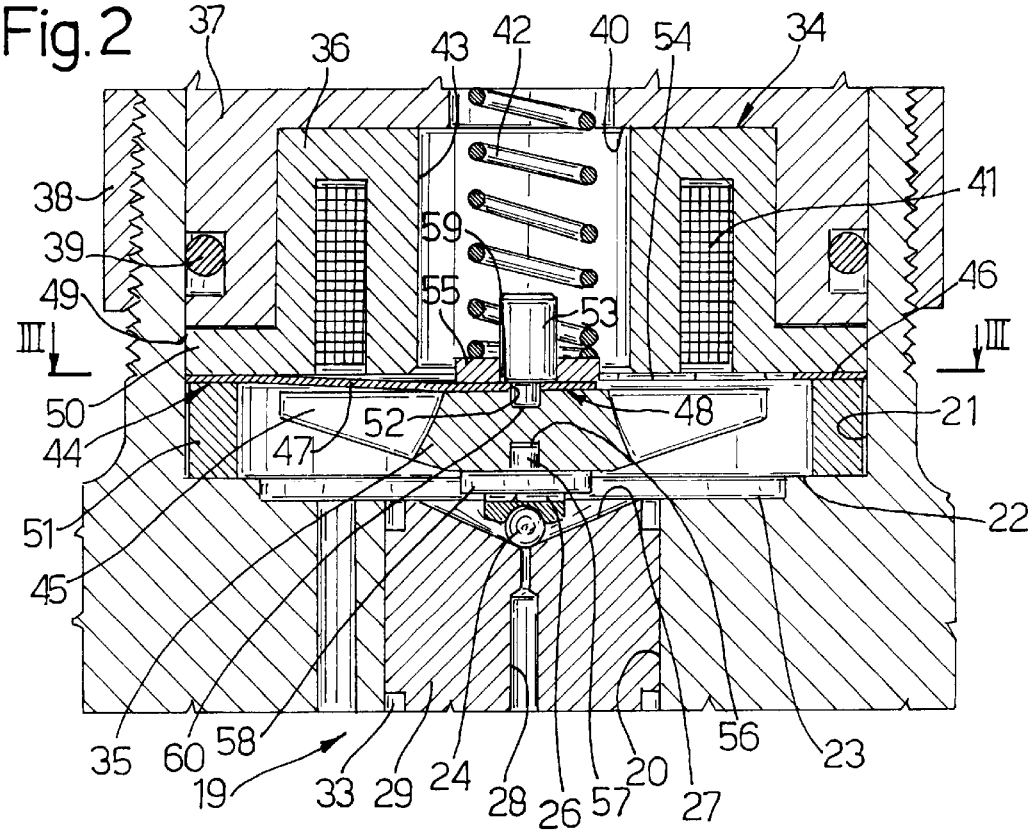
FIG. 2 shows a larger-scale, diametrical section of a portion of the FIG. 1 injector.
Figure 3:
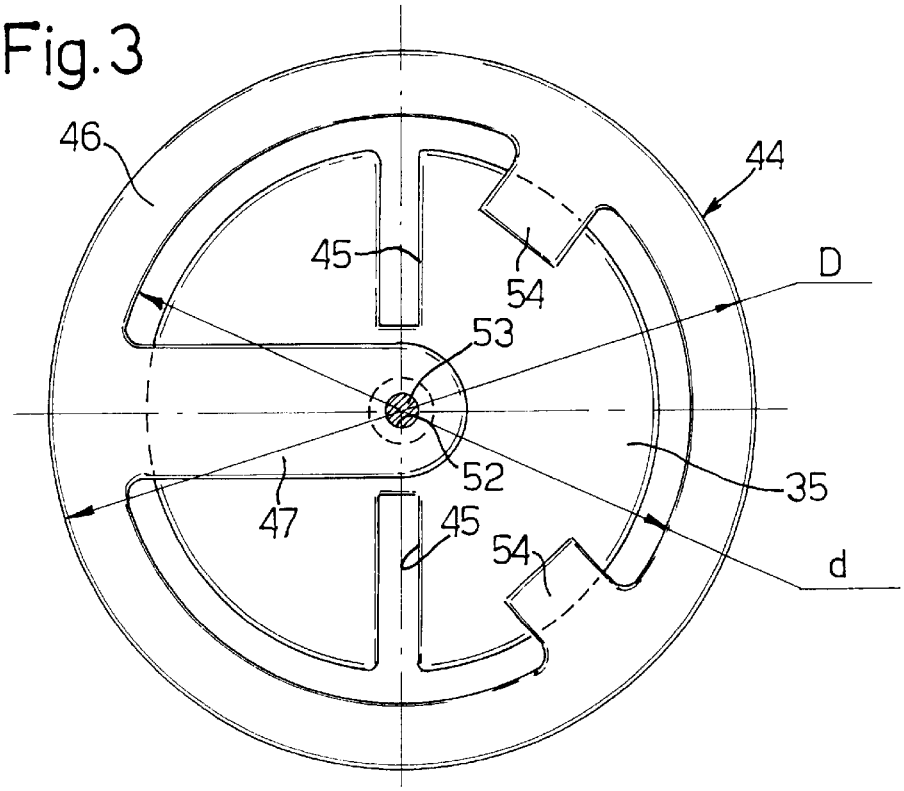
FIG. 3 shows a partial section along line III—III in FIG. 2.

Annular portion 46 of hinge 44 is fixed between sleeve 37 and hollow body 6, while tongue 47 is fixed to a central portion 48 of armature 35 and acts as a cantilever which tends to hold armature 35 with the surface facing core 36 coplanar with the tongue, so as to ensure a radial constraint of hinge 44. When valve 19 is closed, as in FIG. 2, tongue 47 is flexed slightly and exerts a small amount of elastic pressure; and spring 42 normally keeps armature 35 in the closed position closing valve 19 and slightly detached from core 36, as described in detail later on. In FIG. 2, the distance between armature 35 and core 36 is exaggerated for the sake of clarity.

Annular portion 46 of hinge 44 is fixed by ring nut 38 between a flange 50 of core 36 and a ring 51, of calibrated thickness, resting on shoulder 22 of hollow body 6. An end edge 49 of sleeve 37 is therefore detached slightly from flange 50, and annular portion 46 is gripped between flange 50 and ring 51. The thickness of ring 51 is so selected as to define a predetermined axial travel of armature 35 between the position closing valve 19 (FIG. 2) and the position opening valve 19.

Tongue 47 has an opening 52 engaged by a small-diameter portion of an axial pin 53, which serves to secure one end of closing spring 42 and is fitted with a washer 55 on which the end of spring 42 rests. The small-diameter portion of pin 53 is force-fitted inside a depression 60 at central portion 48 of the surface of armature 35 facing core 36, so that tongue 47 is gripped between a shoulder 59 of pin 53 and said surface of armature 35. Tongue 47 may also be fixed to armature 35 by welding the edge of opening 52 to pin 53, or by gluing the tongue to central portion 48.

Annular portion 46 of hinge 44 also comprises two projecting appendixes 54 projecting towards the center and preferably spaced 120° with respect to tongue 47. Appendixes 54 are shorter than tongue 47 and engage the surface of armature 35 facing core 36; and tongue 47 and/or appendixes 54 act as stops for arresting the travel of armature 35 towards core 36. Leaf spring hinge 44 may be die-cut from a sheet of nonmagnetic spring steel of a calibrated thickness selected to define a predetermined air gap between armature 35 and core 36 to assist detachment of armature 35 from core 36 when coil 41 is deenergized. Leaf spring hinge 44 is preferably photoblanking or laserblanking from the sheet, and is therefore extremely cheap to produce.

The surface of armature 35 opposite the one facing core 36 has a further central depression 56 which is engaged by a pin 57 of an actuating member defined by a flange 58 for engaging plate 26 of shutter 24, 26. Flange 58 rests on said surface of armature 35, which therefore acts on shutter 24, 26 with no need for an armature stem in between. Not being guided by rigid guides, armature 35 undergoes no wear and can therefore be made of relatively cheap material with good ferromagnetic properties, such as ferrosilicon, or from sintered powder thereof.

To assemble injector 5, pin 53 is first inserted inside opening 52 in tongue 47; pin 53 is fixed inside depression 60 in armature 35; pin 57 of flange 58 is fixed inside depression 56; valve body 29, together with rod 9, is inserted inside hollow body 6; core 36, together with spring 42, is inserted inside sleeve 37; ball 24 and plate 26 are inserted inside seat 27; ring 51 is inserted inside cavity 21 of hollow body 6; annular portion 46 of hinge 44 is placed on ring 51; and sleeve 37 is connected to hollow body 6 by tightening nut 38, so that core 36 is locked to sleeve 37, annular portion 46 is gripped between flange 50 and ring 51, ring 51 is locked on to shoulder 22, and tongue 47 is gripped between central portion 48 and shoulder 59 of pin 53 to ensure a radial constraint of hinge 44.

Injector 5 operates as follows.

When coil 41 is energized, core 36 attracts armature 35 in opposition to spring 42. Tongue 47 assists in releasing armature 35 from the closed position, and, together with appendixes 54, absorbs the kinetic energy of the armature in balanced manner. Finally, armature 35 is arrested against tongue 47 and appendixes 54, leaving an air gap between itself and core 36. The pressure of the fuel in chamber 28 therefore opens shutter 24, 26 to discharge the fuel through slits 45 in armature 35 and through hole 43 in core 36, so that the pressure of the fuel in chamber 18 (FIG. 1) raises pin 11 together with rod 9 to inject the fuel through orifice 8.

When coil 41 is deenergized, spring 42 moves armature 35 away from core 36 to restore shutter 24, 26 to the FIG. 2 closed position by means of flange 58, so that the high-pressure fuel restores the pressure inside control chamber 28, and pin 11 is restored to the closed position closing orifice 8.

The advantages, with respect to known injectors, of the injector according to the invention will be clear from the foregoing description. Above all, leaf spring hinge 44, with annular portion 46, positions armature 35 precisely inside cavity 21 with no need for a rigid guide to guide the movement of armature 35, the usual stem of which may therefore be dispensed with; and tongue 47 and appendixes 54 of hinge 44 absorb the kinetic energy of armature 35 in balanced manner.

Ring 51 defines a calibrated shim defining the travel of armature 35 to close shutter 24, 26. Hinge 44, being of predetermined thickness, determines the air gap between armature 35 in the open position and magnetic core 36, and also greatly simplifies assembly of armature 35, and therefore of sleeve 37, to hollow body 6. And, finally, not being subject to wear by a rigid guide, armature 35 can be made of low-cost material with good ferromagnetic properties, thus greatly reducing the cost of the injector.

Clearly, changes may be made to the injector as described herein without, however, departing from the scope of the accompanying Claims. For example, tongue 47 and/or appendixes 54 may be preloaded elastically to exert a given elastic pressure on armature 35 in the closed position closing valve 19; and hinge 44 may comprise a different number of appendixes 54 and/or two or more radial spokes as opposed to a single tongue 47.

Fastening portion 46 of hinge 44 may be other than annular; the thickness of annular portion 46 may differ from that of tongue 47 and appendixes 54; and core 36 may have no flange 50, and end edge 49 be such as to grip portion 46 against ring 51 directly.

What is claimed is:

1. An internal combustion engine fuel injector comprising a hollow body (6) housing a fuel metering valve (19); and a support (37) connected to said hollow body (6) and housing an electromagnet (34) controlling an armature (35) in turn controlling said valve (19); said valve (19) closing a control chamber (28) on which high-pressure fuel acts; said valve (19) normally being closed by a closing spring (42) acting on said armature (35) and which overcomes the action of the fuel in said control chamber (28); and said valve (19) being opened when said electromagnet (34) activates said armature (35) to overcome the action of said closing spring (42); characterized in that said armature (35) is fitted inside said hollow body (6) by means of a leaf spring hinge (44) comprising a first portion (46) fixed between said hollow body (6) and said support (37), and a second portion (47) fixed to said armature (35).

2. An injector as claimed in claim 1, wherein said support comprises a sleeve (37); said electromagnet (34) having an annular core (36) inserted inside said sleeve (37); characterized in that said first portion (46) is annular with an inside diameter (d) greater than that of said armature (35), and with an outside diameter (D) such as to fit inside said hollow body (6) with no radial clearance.

3. An injector as claimed in claim 2, characterized in that said second portion (47) projects radially inwards from said first portion (46); said second portion (47) being fixed to a central portion (48) of said armature (35).

4. An injector as claimed in claim 3, characterized in that said central portion (48) has an axial pin (53) by which to secure said closing spring (42); said second portion (47) having an opening (52) engaging said axial pin (53), and being gripped between said central portion (48) and a shoulder (59) of said axial pin (53) to ensure a radial constraint of said leaf spring hinge (44).

5. An injector as claimed in claim 2, characterized in that said first portion (46) comprises at least one projecting appendix (54) projecting inwards; said projecting appendix (54) engaging a surface of said armature (35) facing said core (36).

6. An injector as claimed in claim 5, characterized in that at least said second portion (47) and/or said projecting appendix (54) of said leaf spring hinge (44) arrest the travel of said armature (35) towards said core (36), and are of calibrated thickness to define a predetermined air gap between said armature (35) and said core (36).

7. An injector as claimed in claim 2, characterized in that said first portion (46) is fixed between said hollow body (6) and said sleeve (37) with the interposition of a ring (51) of calibrated thickness, so as to define a predetermined travel of said armature (35) between an open position and a closed position respectively opening and closing said valve (19).

8. An injector as claimed in claim 2, characterized in that said core (36) has a flange (50); said first portion (46) being fixed between said hollow body (6) and said flange (50) with the interposition of a ring (51) of calibrated thickness, so as to define a predetermined travel of said armature (35) between an open position and a closed position respectively opening and closing said valve (19).

9. An injector as claimed in claim 2, wherein said valve (19) comprises a shutter (24, 26) engaging a seat (27) communicating with said control chamber (28); characterized in that said armature (35) is fitted with an actuating member (58) directly contacting a surface of said armature (35) and for engaging said shutter (24, 26).

10. An injector as claimed in claim 9, characterized in that said armature (35) is made of material with good ferromagnetic properties; said armature (35) having, in said central portion (48), a first depression (60) into which said axial pin (53) is forced.

11. An injector as claimed in claim 10, characterized in that said actuating member is defined by a flange (58); said armature (35) having a second depression (56) opposite said first depression (60); and said flange (58) having an appendix (57) which is forced inside said second depression (56).

12. An injector as claimed in claim 2, characterized in that said leaf spring hinge (44) is photoblanking or laserblanking from sheet metal of constant thickness.

* * * * *

UNITED STATES PATENT AND TRADEMARK OFFICE

CERTIFICATE OF CORRECTION

PATENT NO. : 6,443,132 B1
DATED : September 3, 2002
INVENTOR(S) : Mario Ricco et al.

It is certified that error appears in the above-identified patent and that said Letters Patent is hereby corrected as shown below:

Title page,
Item [73], "R.F." should read -- C.R.F. --.

Signed and Sealed this

Thirty-first Day of December, 2002

JAMES E. ROGAN
*Director of the United States Patent and Trademark Office*